US005582940A

United States Patent [19]

Kim

[11] Patent Number: 5,582,940

[45] Date of Patent: Dec. 10, 1996

[54] METHOD FOR PRODUCTION OF GRAPH SCALE OF CATHODE-RAY TUBE PANEL FOR A OSCILLOSCOPE

[75] Inventor: Kyung C. Kim, Taegu-shi, Rep. of Korea

[73] Assignee: Orion Electric Co., Ltd., Kyungsangbuk-do, Rep. of Korea

[21] Appl. No.: 379,447

[22] PCT Filed: Aug. 5, 1992

[86] PCT No.: PCT/KR92/00038

§ 371 Date: Feb. 28, 1995

§ 102(e) Date: Feb. 28, 1995

[87] PCT Pub. No.: WO94/03917

PCT Pub. Date: Feb. 17, 1994

[51] Int. Cl.[6] ..... G03C 5/00

[52] U.S. Cl. ..... 430/23; 430/24; 430/25

[58] Field of Search ..... 430/23, 24, 25, 430/321, 396

[56] References Cited

U.S. PATENT DOCUMENTS 4,983,499 1/1991 Sazuki et al. ..... 430/321

FOREIGN PATENT DOCUMENTS 44-17932 8/1969 Japan .
46-42456 12/1971 Japan .
49-45947 12/1974 Japan .
60-17834 1/1985 Japan .
1-239725 9/1989 Japan .

*Primary Examiner*—S. Rosasco
*Attorney, Agent, or Firm*—Watson Cole Stevens Davis, P.L.L.C.

[57] ABSTRACT

A method for production of graph scales of a panel of a cathode-ray tube for an oscilloscope for forming the panel graph scales by exposing and developing a slurry precipitate on a panel through a mask having cathode scales. More particularly, the present invention relates to a panel graph scale production method of a novel type characterized in that a specific filter having light transmissivity of about 62% at the center is disposed between the mask and a light source. According to this method, it is not necessary to arrange a large number of parallel ray lenses between the mask and the light source as opposed to the prior art, the distance between the panel and the light source can be more reduced, the overall exposure system for producing the scales can be more simplified, and the intended panel graph scales can be produced under an ideal condition.

3 Claims, 7 Drawing Sheets

METHOD FOR PRODUCTION OF GRAPH SCALE OF CATHODE-RAY TUBE PANEL FOR A OSCILLOSCOPE

BACKGROUND OF THE INVENTION

The present invention relates to a new method for forming graph scales on the panel of a CRT for oscilloscope, in method for forming graph scales on the panel by Exposition & Development System being characteristic of placing between a negative mask for the graph scale patterns and a light source a specific filter whose light transmissivity at its center is about 62% and gets larger along from its center to its peripheral portions.

In general, for example as shown in FIG. 1, the graph scale patterns including the scales for graph coordinates 1 and other necessary numerical values 2 are drawn on the surface of the panel(P) of the CRT for a oscilloscope. In the past, these graph scale patterns have been made by the method of attaching on the panel a transparent plastic board on which the necessary graph patterns are provided, but recently either by one method in which the graph patterns are directly drawn on the panel surface before complishing a glass bulb consisting of a Panel part and a Funnel part or by another method of forming the necessary graph scale patterns on the inner surface of the panel by light exposure and development means well known to the CRT manufacturers. In the above, the latter is preferred above all owing to its lower cost and the advantage in recycling the glass bulb.

One recent method frequently used by CRT manufacturers is as follows:

The inside of a glass bulb, which is arranged so that its panel part is downward, is filled with a slurry comprising suitable pigment, water, photo-sensitive agents and so on. Negative mask(M), a film on which a negative graph scale patterns 1' are provided for example as shown in FIG. 2, is arranged outside the panel part in parallel to the panel part. Then, the necessary graph scale patterns are obtained by exposing and developing the slurry precipitates deposited on the inner surface of the panel part of the bulb by the light from a light source.

The above-mentioned method has the problems as follows;

1. The mercury lamp generally used in this method does not provide monochromatic light beams but provides light beams of various wavelengths. Therefore, it is difficult to obtain correct graph scale patterns since the refractive index of the light beams passing through the collimating lens means are different from each other.
2. The light is likely to disperse when it passes through the lens means since the lamp is not a point-light source but is a surface-light source.
3. The light also disperses due to the ununiformity of the quality of the lens means themselves and the intensity of light drops due to the light transmissivity of each of the lens means.
4. The distance from the light source to the panel gets too far since a large number of lens means should be used in order to get correct collimating light beams. As a result, the intensity of the light is significantly reduced when it reaches the slurry precipitates.

In the above, if the graph scale patterns made without the lens means so as to solve the above-mentioned problems involved in using them, the obtained graph scale patterns may be different from the intended ones because of the odds of the incident angles of light arrived at each position of the mask and the panel. Also the ideal pattern lines with a uniform thickness can not be obtained due to the odds of the intensity of light arriving at each parts of the panel.

SUMMARY OF THE INVENTION

It is an object of the present invention to provide an improved method that can effectively solve the problems mentioned above in forming graph scale patterns on the panel of a CRT, particularly to provide a method with the outstanding feature and benefit of being able to make the ideal graph scale patterns as required using a specific filter means as described hereinafter.

To accomplish the object of the present invention, there is provided a method for forming graph scale patterns on the panel of a CRT for oscilloscope comprising the steps of exposing and developing the slurry precipitates deposited on the inner surface of the panel with the light from a light source passing through a mask film which has the negative of the graph scale patterns to be formed, a glass plate and the panel, characterized in that a specific filter is used whose light transmissivity gets larger along from its center to its peripheral portions. Preferably, the light transmissivity of the filter is about 62% at the center portion of the filter. Preferably, the size of the negative graph scale patterns on the mask is about 94.5–95% of that of the real graph scale patterns to be formed on the panel.

BRIEF DESCRIPTION OF THE DRAWINGS

Additional objects and advantages of the present invention will be more clearly understood through the following descriptions on a preferred embodiment thereof with reference to the accompanied drawings in which:

FIG. 3(*b*) is a schemetic diagram describing the construction of a exposure system used in the prior art;

DETAILED DESCRIPTION OF THE INVENTION

Figure 3A:
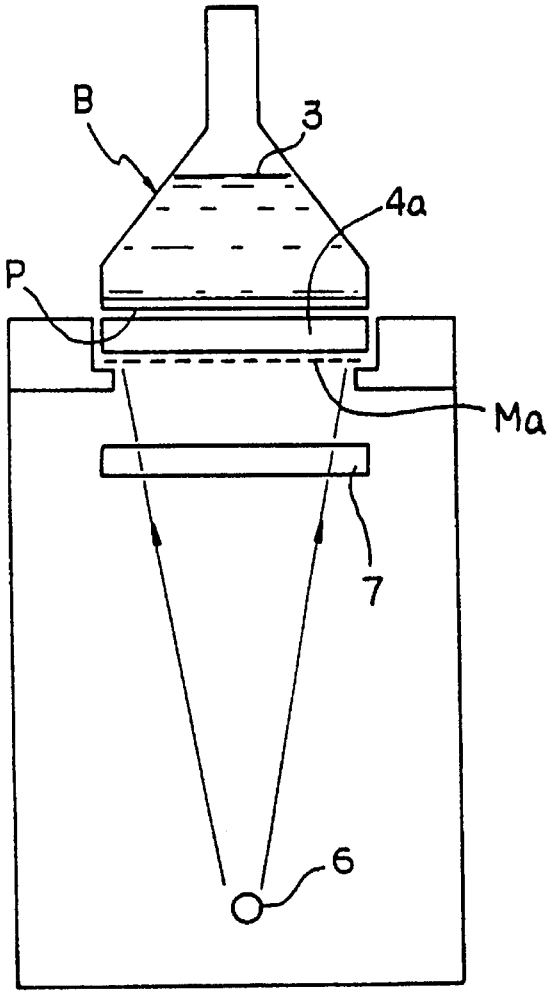
FIG. 3(*a*) is a schemetic diagram describing the construction of a exposure system for carrying out the method of the present invention.
Figure 3B:
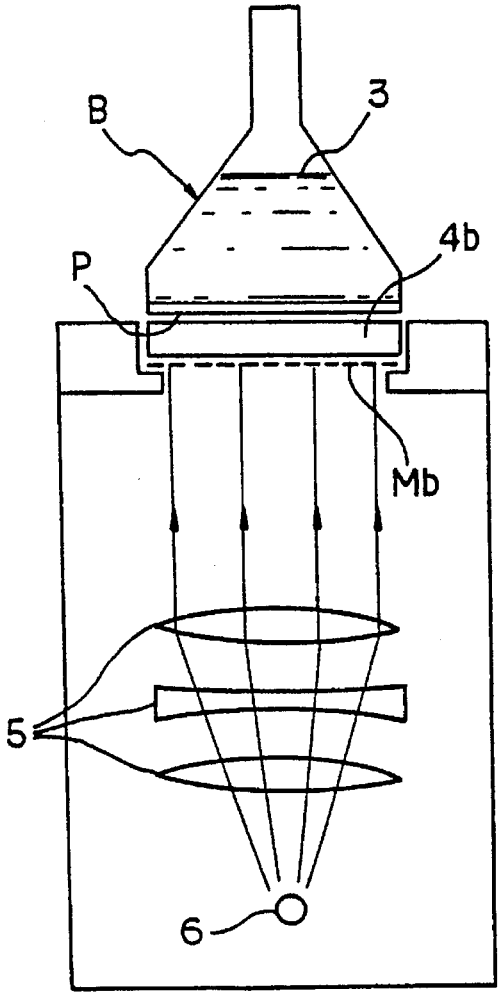
FIG. 3b (PRIOR ART)

The best embodiment of the present invention for desirably achieving the noted object will be discussed in detail with reference to the accompanying drawings. FIG. 3(*a*) is a schemetic view showing the system for carrying out the method according to the present invention and FIG. 3(*b*) is a schemetic view showing the system for carting out the conventional method.

As well understood from FIG. 3(*b*), the conventional method for forming graph scale patterns on the panel of a CRT comprises the step of arranging a Glass Bulb(B) filled with a slurry 3 which is material used for forming the graph scale patterns on a supporting glass plate 4*b*, a mask(Mb) on which the negative of the required graph scale patterns are formed, a plurality of collimating lens means 5 and a light source 6, the step of exposing the slurry precipitates deposited on the inner surface of the panel (P) to the light passed through the lens means 5, the mask(Mb), the glass plate 4*b* and the panel (P) in order from the light source 6, and the step of developing. This method has many problems as previously mentioned.

On the other hand, according to the method of the present invention, as shown in FIG. 3(*a*), the mask(Mb) used in the above conventional method is replaced with a mask(Ma) having the reduced negative of the graph scale patterns to be formed, the size of which is about 95% of that of the real graph scale patterns to be formed on the panel, and a specific filter 7 is placed between the mask(M a) and the light source 6. With the above, the construction of the concerned system can be simplified, and the intensity of light scarcely drops and the light scarcely disperses because the distance between the panel (P) part of glass bulb(B) and the light source 6 become much shorter. And thus, the best forming of the required graph scale patterns are obtained.

Additionally, by the present invention, the thickness of supporting glass plate 4*a* on which the Bulb(B) is placed may be advantageously reduced to minimize the refractive index of the glass plate 4*a* and to maximize the light transmissivity of the glass plate.

Figure 1:
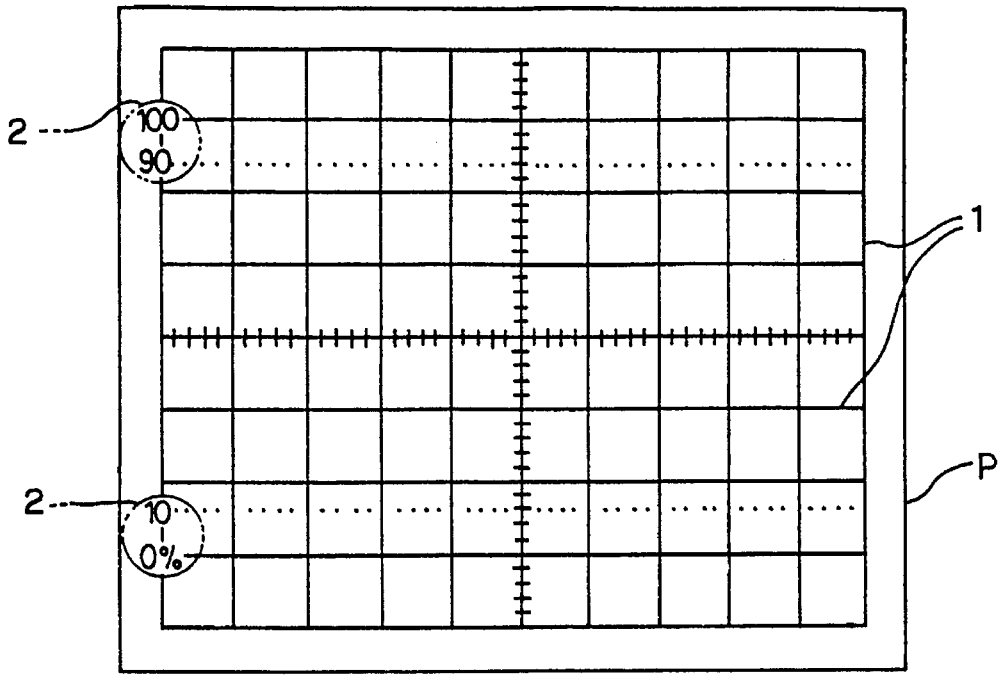
FIG. 1 is a front view of the CRT panel on which the graph scales patterns are formed.
Figure 2:
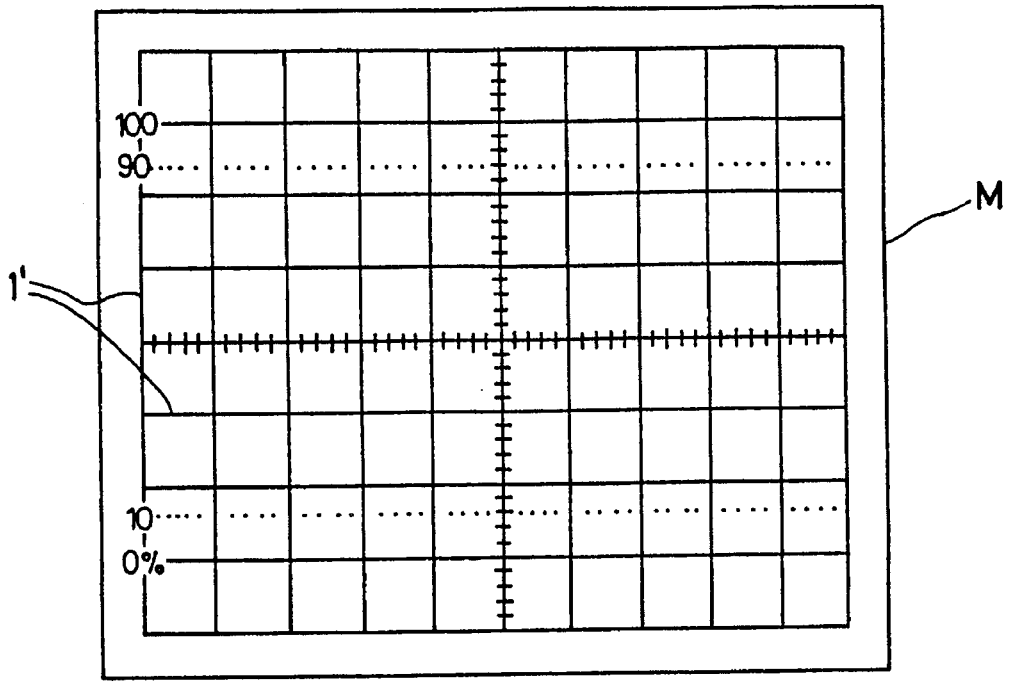
FIG. 2 is a front view of a mask having a negative of the graph scale patterns to be formed.
Figure 4:
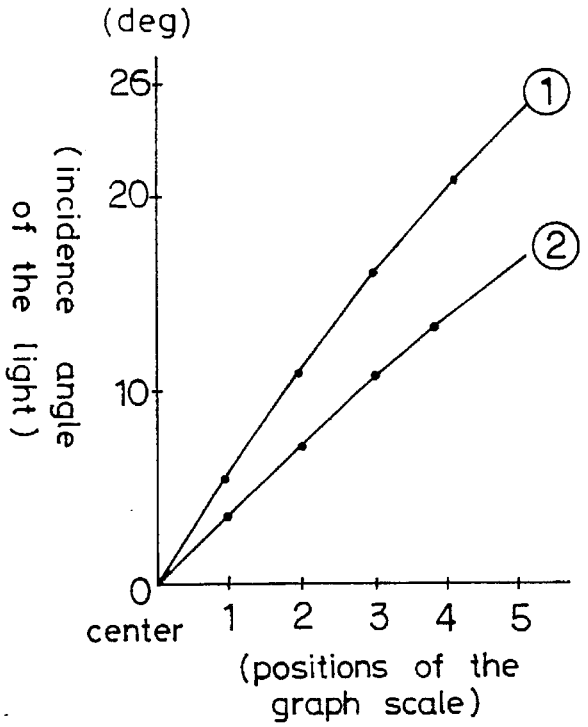
FIG. 4 is a graph showing the incident angle of light on the panel and the ejective angle of light arriving at the inner surface of the panel.

As one of the research steps for achieving the method of the present invention, the incident angle of light according to the distance between each graph scale (as shown in FIG. 1) from the panel center at an exposure system which properly set without filter 7 or lens means 5 and the refractive angle of light arriving at the inner surface of the panel from mask hole are measured. A graph in FIG. 4 shows the measured result. Here, ① is a line showing the incident angle of light at each position on panel according to the panel scale distance on the basis of the panel center and ② is a line showing the refractive angle passing glass plate from mask hole.

Figure 5:
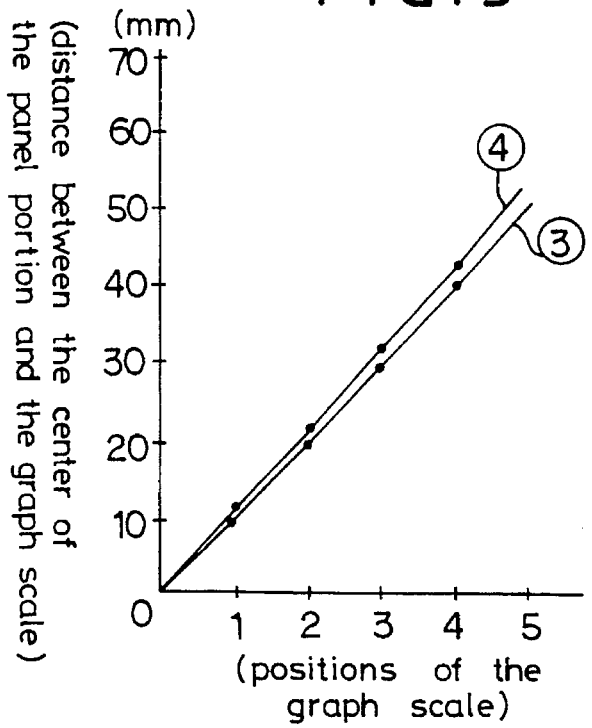
FIG. 5 is a graph showing the gaps between the graph scale lines formed on the panel and the values of the designed scales on the mask.

Also, FIG. 5 is a graph showing the measured result of the difference between practical graph scales drawn on panel and that designed on the mask. Here, ③ is a line showing the design distance of mask scale according to each scale position at the center of panel and ④ is a line showing the scale distance drawn on practical panel. And the difference between values of said two distances is defined as.

Figure 6:
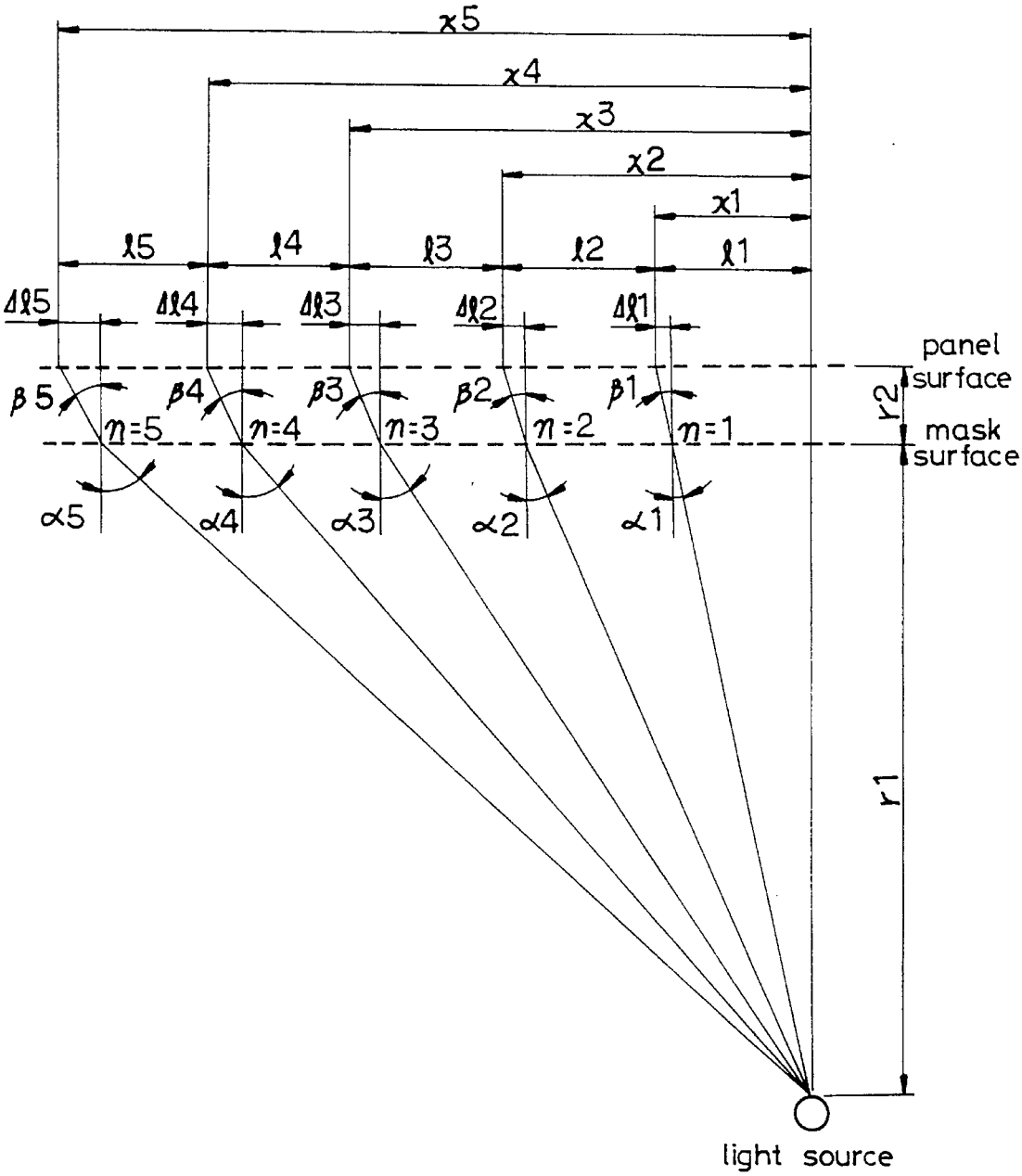
FIG. 6 is a diagram describing the theoretical background of FIG. 4 and FIG. 5.

Next, referring to FIG. 6 the theoretical background on FIG. 4, FIG. 5 and Table 1 will be discussed. The light emitting from the light source is refracted on arriving at the mask surface. Calculating the displacement by Snell's rule, it is as follows;

$$n_0 \mathrm{SIN}\alpha_n = n_1 \mathrm{SIN}\beta_n$$

$$\Delta l = \gamma_2 \tan\beta_n$$

Wherein, $n_0$ indicates the refractive index of air($n_0$=1), $n_1$ the refractive index of glass ($n_1$=1.5), $\gamma_1$ the distance from light source to mask (here 105 mm), $\gamma_2$ the distance from mask to the inner surface of panel (here 10 mm), $X'_n$ the distance from the mask center designed, $X_n$ the distance from the center of graph scale drawn in the inner surface of panel, $\alpha_n$ the incident angle to mask hole from light source, $\beta_n$ the incident angle from mask hole to the inside surface of panel, $\Delta l$ the difference between designed values of mask and the scale distance drawn at the inner surface of panel and $l_n$ the theoretical space of each scale drawn at the inner surface of panel.

Next, Table 1 below has been derived as a result of measuring each value of the above defined values at a position corresponding to each scale on panel when using 1:1 mask.

TABLE 1

| | | POSITION (n) | | | | |
|---|---|---|---|---|---|---|
| ITEM | UNIT | 1 | 2 | 3 | 4 | 5 |
| X'n | mm | 10.000 | 20.000 | 30.000 | 40.000 | 50.000 |
| Xn | mm | 10.633 | 21.275 | 31.863 | 42.443 | 52.992 |
| αn | deg | 5.44 | 10.78 | 15.95 | 20.85 | 25.46 |
| βn | deg | 3.62 | 7.17 | 10.55 | 13.73 | 16.66 |
| Δln | mm | 0.633 | 1.257 | 1.863 | 2.443 | 2.992 |
| ln | mm | 10.633 | 10.624 | 10.606 | 10.508 | 10.549 |

As seen from the result of the above Table 1, the scale has not been made in the range of standard tolerance because the tolerance of scale (judging by $l_n$ values) went off the standard tolerance 10±0.08.

And as the result of using the reduced mask of 94.5%, the scale can be made in the range of the above standard tolerance as shown in below Table 2, and using the reduced mask of 95%, the scale can be formed in the range enough allowable tolerance as shown in below Table 3 and conventional exposure time of 3–5 minutes can be greatly reduced up to 30–60 seconds owing to light quantity increased by reducing exposure distance more than 50% of that when using lens means 5.

TABLE 2

| the scale spaces drawn on the panel when using the reduced mask of 94.5% | | | | | |
|---|---|---|---|---|---|
| POSITION (n) | 1 | 2 | 3 | 4 | 5 |
| SPACE (mm) | 10.048 | 10.039 | 10.02 | 9.998 | 9.985 |

TABLE 3

| | the values measured practically of scale drawn on the panel when using the reduced mask of 94.5% (unit mm) | | | | |
|---|---|---|---|---|---|
| | VALUES OF ALL SCALES | | VALUES OF EACH SCALE | | |
| ITEM | PRACTICAL PART | STANDARD | PRACTICAL PART | STANDARD | etc |
| HORIZONTAL PART | 99.66 | 100 + 0.8 | Max: 10.04<br>Min: 9.98 | 10 + 0.08 | |
| VERTICAL PART | 79.68 | 80 + 0.6 | Max: 01.03<br>Min: 9.99 | 10 + 0.08 | |

However, in the extension exposure method not using lens, the thickness of scale being exposed and developed at the inner surface of the panel is not uniform because the difference of each light quantity arrived is too big at the edge and center of the panel if the exposure distance is short.

In order to cope with the above problem in the present invention, a specific filter as explained below has been used.

Figure 7:
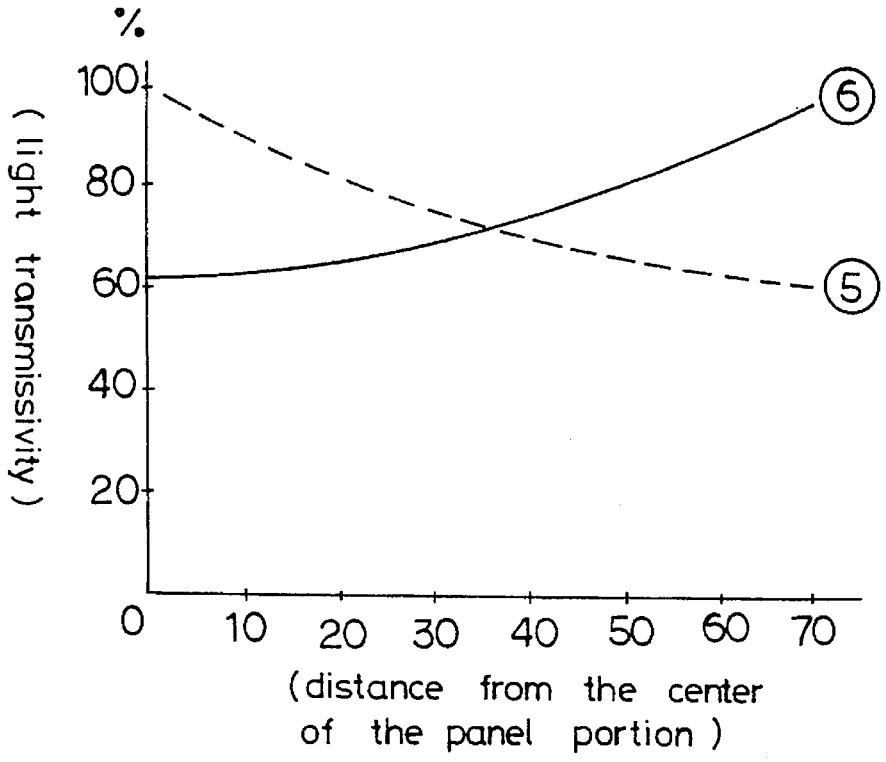
FIG. 7 is a graph showing the variation of the light transmisivity of the panel from its center to its peripheral portions.

First, FIG. 7 is a graph describing the variation of transmission factor of light from the panel center receiving the light emitted from one light source to the edge, wherein ⑤ and ⑥ indicate the line of transmission factor in inverse function and infunction, respectively. The theoretical principle and general equation for seeking transmission factor and illuminance according to the distance variation from the center are as follows;

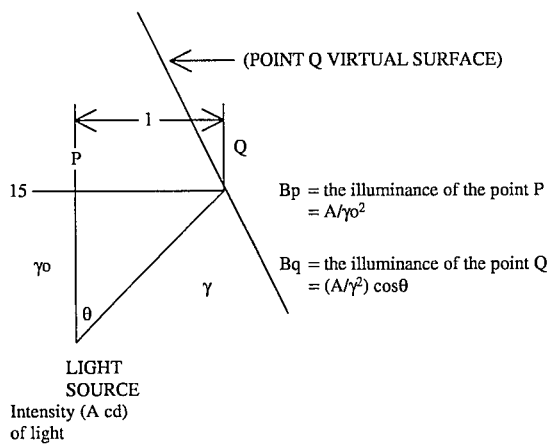

$$\frac{Bq}{Bp} = \frac{\frac{A}{\gamma_0^2 + l^2} \times \frac{\gamma_0}{\sqrt{\gamma_0^2 + l^2}}}{\frac{A}{\gamma_0^2}} = \frac{\gamma_0^3}{(\gamma_0^2 + l^2)^{3/2}}$$

$$\gamma = \sqrt{\gamma_0^2 + l^2}$$

$$\cos\theta = \frac{\gamma_0}{\sqrt{\gamma_0^2 + l}}$$

In above case, when $\gamma$=115 mm, l=70 mm, the light quantity at the panel edge is Bq/Bp=0.62, that is, 62% of the light quantity of the panel center. Accordingly, if the light quantity of the panel center is reduced to 62% by using the specific filter so as to compensate this, the light quantity of all surface of the panel can be controlled uniformly.

Suppose the relation between the transmission factor of filter and the illuminance of panel is inverse function, the transmission factor of each scale distance from the panel center becomes the result as shown in FIG. 4.

In first, the illuminance equation of panel is as follows;

$$B(\text{ILLUMINANCE}) = \frac{A}{\gamma^2}\cos\theta = \frac{A\gamma_0}{(\gamma_0^2 + l^2)^{3/2}}$$

The equation for yielding the transmission factor is as follows;

$$\text{TRANSMISSION FACTOR: } T \quad T(l) = \frac{1}{B} + K_2 = \frac{1}{A\gamma_0}(\gamma_0^2 + l^2)^{3/2} + K_2 = K_1(11.5^2 + l^2)^{3/2} + K_2$$

Therefore when l=0 (center), T(l)=62(%)

when l=7 cm, T(l)=100(%), and a general equation of transmission factor $T(l)=0.0413(11.5+l^2)^{3/2}=0.8$ is obtained.

TABLE 4

| THE DISTANCE FROM THE CENTER 1 (on) | 0 | 1 | 2 | 3 | 4 | 5 | 6 | 7 |
|---|---|---|---|---|---|---|---|---|
| TRANSMISSION FACTOR (%) | 62 | 63 | 65 | 69 | 74 | 81 | 89 | 100 |

Figure 9:
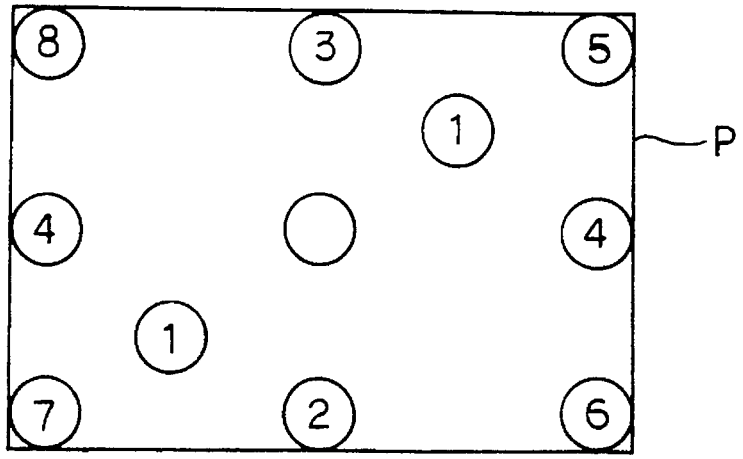
FIG. 9 is a diagram showing the selected positions on the panel for measuring from which FIG. 8 and FIG. 10 results.
Figure 8:
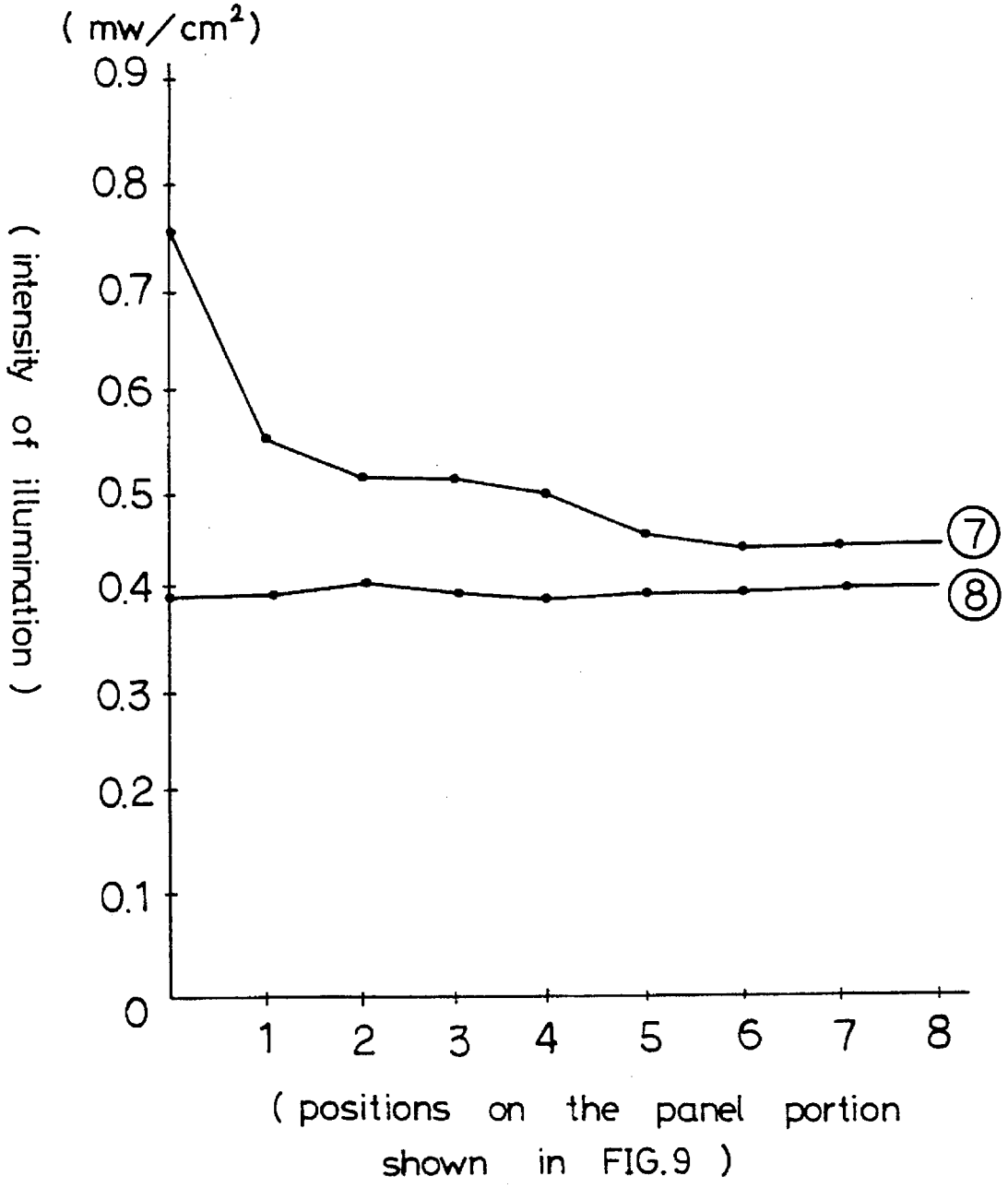
FIG. 8 is a graph showing the illuminance at each selected position on the panel after and before using the filter according to the present invention.

Next, FIG. 8 is a graph describing the illuminance after and before using the filter (as shown in FIG. 3) having the transmission factor of which is 62% in the center and becomes larger at the edge, wherein ⑦ indicates the illuminance before using the said filter, ⑧ the illuminance after using the filter. The illuminance measured at each position on the panel in FIG. 9 is shown in Table 5.

TABLE 5

(unit: mw/cm)

| ITEM | POSITION | | | | | | | | |
|---|---|---|---|---|---|---|---|---|---|
| | CENTER | 1 | 2 | 3 | 4 | 5 | 6 | 7 | 8 |
| ILLUMINANCE (BEFORE USING-FILTER) | 0.76 | 0.55 | 0.52 | 0.52 | 0.50 | 0.46 | 0.45 | 0.45 | 0.45 |
| ILLUMINANCE (AFTER USING FILTER) | 0.39 | 0.40 | 0.41 | 0.40 | 0.39 | 0.40 | 0.40 | 0.41 | 0.41 |

Therefore, the (measured) result of measure shows the illuminance of each position on the panel is almost regular when using the filter of which the center transmission is 62%.

Figure 10:
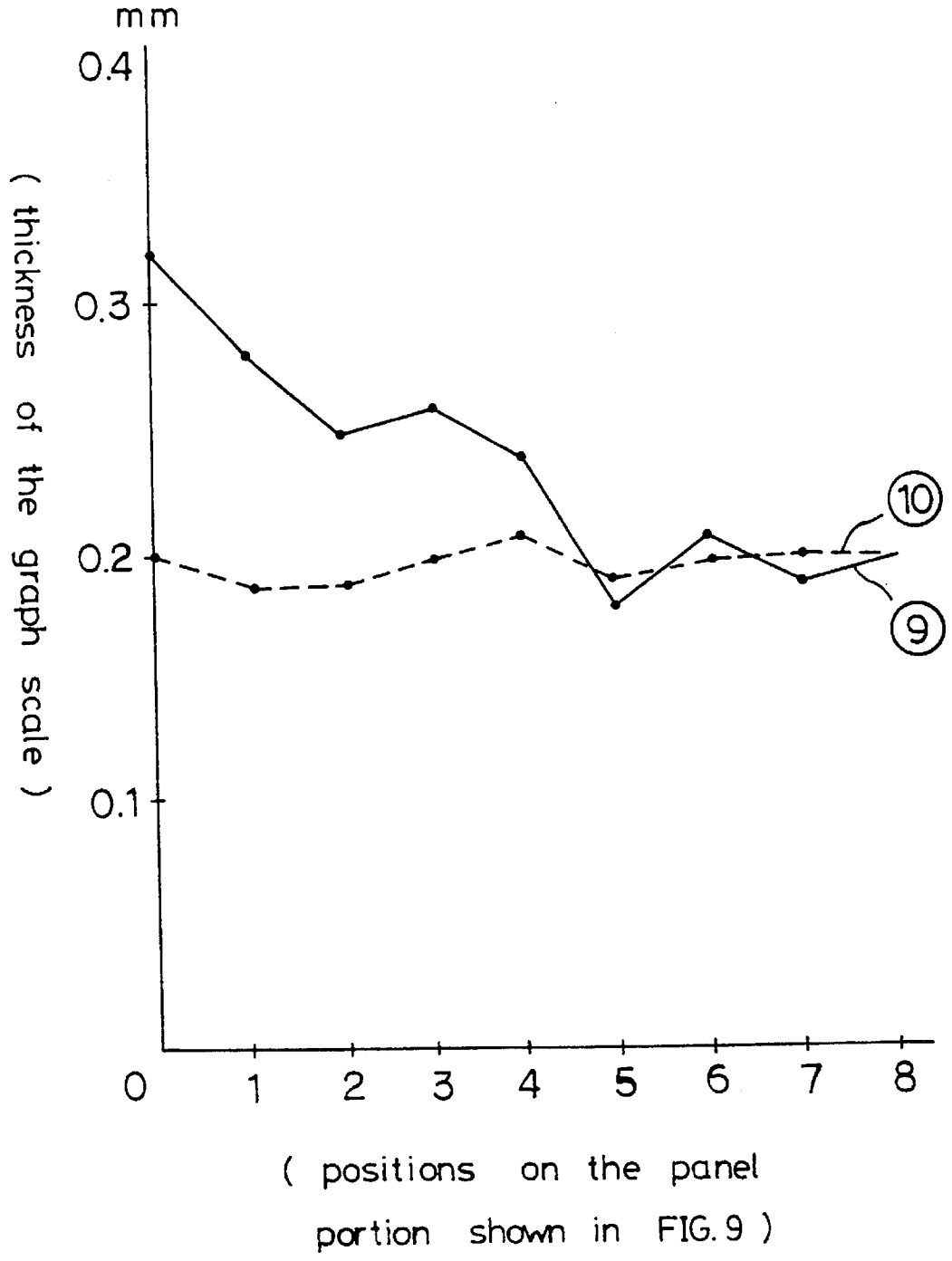
FIG. 10 is a graph showing the thickness of scale lines formed at each position on the panel before and after using the filter according to the present invention.

Next, FIG. 10 is a graph describing the thickness of lines developed at each position on the panel shown in FIG. 9 after and before using the filter, wherein ⑨ and ⑩ indicate the line describing the thickness of line developed at the panel before using the filter and when using the filter, respectively, The below Table 6 is the result confirming the thickness of the scale lines in case exposure time is minute and the center illuminance is 0.40 mw/cm$^2$.

TABLE 6

The thickness of line before and after using the filter (unit: mm)

| ITEM | POSITION | | | | | | | | |
|---|---|---|---|---|---|---|---|---|---|
| | CENTER | 1 | 2 | 3 | 4 | 5 | 6 | 7 | 8 |
| THICKNESS (BEFORE USING FILTER) | 0.32 | 0.28 | 0.25 | 0.26 | 0.24 | 0.18 | 0.21 | 0.19 | 0.20 |
| THICKNESS (AFTER USING FILTER) | 0.20 | 0.19 | 0.19 | 0.20 | 0.21 | 0.19 | 0.20 | 0.20 | 0.20 |

From Table 6, we can know the facts as follows;

The thickness of scale lines on the panel exposed and developed by the arrangement of FIG. 3(*a*) using the filter whose light transmissivity at its center is about is 62% satisfies the allowable condition in the standard tolerence of 0.2+0.05 mm with maintaining almost uniform thickness at all positions from the center to the edge. On the contrary, in case the filter is not used the thickness difference of scale lines on the panel is too large, so that it is not possible to apply it to the product. Moreover, the difference the shorter exposure time or the lower the illuminance, the larger.

The method according to the present invention making use of exposure system including the filter means can be very profitably applied not only to the case mentioned above but also to any exposure system needing collimating light beams.

As well understood from the above description, the method according to the present invention for forming graph scale patterns on the panel of a CRT for osciloscope has the following advantages, that is, the distance between the panel and the light source can be drastically reduced by using a specific filter instead of using several collimating lens means which have been used in the conventional methods, the overall exposure construction of the concerned system can be greatly simplified, and the best forming of the intended graph scale patterns can be obtained.

What is claimed is:

1. A method for forming graph scales on the panel of a cathode-ray tube panel for an oscilloscope comprising the steps of arranging a glass bulb (B) filled with a slurry (3), a glass plate (4*a*) for supporting said bulb (B), a mask (Ma) having a negative of the graph scale to be formed on the inner surface of the panel portion (P) of said bulb (B), and a light source (6) in the required order; forming the graph scale on the inner surface of the panel portion (P) of said bulb (B) by exposing and developing the slurry precipitate on the inner surface of the panel portion (P) by means of the light directed thereto from said light source (6) through the mask (Ma), the glass plate (4*a*) and the panel portion (P), and arranging a filter (7) whose light transmissivity increases from its center to its peripheral portions between said mask (Ma) and said light source (6).

2. The method according to claim 1, wherein said mask (Ma) has the negative of the graph scale with a size about 94.5–95% of that of the graph scale to be formed on the panel portion (P).

3. The method according to claim 1, wherein the light transmissivity at the center of said filter (7) is about 62%.

* * * * *